United States Patent [19]

Price

[11] Patent Number: 4,589,852

[45] Date of Patent: May 20, 1986

[54] MOISTURE INHIBITOR

[76] Inventor: Donald G. Price, P.O. Box 833, Dana Point, Calif. 92629

[21] Appl. No.: 671,625

[22] Filed: Nov. 15, 1984

[51] Int. Cl.[4] ..... B63H 21/26

[52] U.S. Cl. ..... 440/89; 440/88; 114/211; 55/446; 55/DIG. 30; 60/309; 60/310

[58] Field of Search ..... 440/88, 89; 114/173, 114/177, 201 R, 211, 212; 98/90, 91, 92; 210/521, 532.2; 55/49, 50, 54, 245, 426, 446, DIG. 30; 60/309, 310

[56] References Cited

U.S. PATENT DOCUMENTS

| | | | |
|---|---|---|---|
| 3,282,047 | 11/1966 | Wertheimer | 60/310 |
| 3,340,859 | 9/1967 | Williamson | 60/310 |
| 3,747,347 | 7/1973 | Ciraolo | 60/309 |
| 3,834,341 | 9/1974 | Sexton | 440/89 |
| 3,921,398 | 11/1975 | Kashmerick | 440/89 |
| 3,968,767 | 7/1976 | Blanchard | 440/89 |
| 4,019,456 | 9/1977 | Harbert | 440/89 |
| 4,337,054 | 6/1982 | Holtermann et al. | 440/89 |
| 4,448,112 | 5/1984 | Söderberg | 114/211 |

*Primary Examiner*—Trygve M. Blix
*Assistant Examiner*—C. T. Bartz
*Attorney, Agent, or Firm*—Lawrence D. Sassone

[57] ABSTRACT

A moisture inhibitor comprising a housing having a cavity, an entrance port passing through the housing to the cavity of the housing and an exit port passing through the housing to the cavity of the housing and a dividing wall inside the housing in the cavity of the housing coupled to the housing between the entrance port and the exit port wherein the dividing wall rises up in the cavity of the housing above the entrance port and above the exit port and a lower trap coupled to the housing below the entrance port and a sloped floor coupled to the housing below the entrance port which slopes down and away from the entrance port towards the lower trap and is coupled to the lower trap and an upper trap coupled to the housing in the cavity of the housing above the entrance port and a sloped wall coupled to the dividing wall so that the sloped wall slopes down and away from the entrance port towards the exit port and cooling means.

11 Claims, 11 Drawing Figures

MOISTURE INHIBITOR

BACKGROUND OF THE INVENTION

Many boats have marine engines that have a wet exhaust system. In a wet exhaust system fluids are introduced into the exhaust system or the exhaust is forced through an aqualift. Typically water is introduced into the exhaust system where the water has previously been used as engine coolant. An aqualift is in substance a box partially filled with water where the exhaust gases are introduced in the aqualift and enter the aqualift under the water in the aqualift and eventually the exhaust gases build up pressure in the aqualift and are forced out of the aqualift under the water in the aqualift through a pipe that eventually carries the exhaust and the water in the exhaust system out of the boat. However, when the engine in the boat is shut off the hot exhaust gases in the exhaust pipe between the engine and the aqualift will cool and become more dense and exert less pressure in the exhaust pipe between the engine and the aqualift which will suck or syphon water in the aqualift into the exhaust pipe leading to the engine and some of this water will vaporize because of the high temperature of the exhaust pipe and will form steam and carry contaminants such as salt in the exhaust pipe back towards the engine. Some of this moisture and contaminants will actually enter the engine since most of these engines have reciprocating pistons which require valves some of which are left open after the engine shuts off. Thus moisture, gases, steam and contaminants may enter the engine through the exhaust system after the engine is shut off. This can result in considerable engine damage since water can cause rust and salt is very corrosive. The only known device in the prior art that addresses this problem is a simple loop in the exhaust pipe between the engine and the aqualift. The loop is simply a raised portion of the exhaust pipe between the engine and the aqualift. The loop resembles a small upside down U. It is unknown whether there are any patents on the loop or whether there is even any written literature on it. The loop performs its function very poorly because it has no traps and does not catch or hold liquids and does not precipitate or condense gases or steam.

Thus there is nothing known in the prior art that solves a problem that has existed in boats for years that have wet exhaust systems and, in such, the invention herein is unique and novel.

SUMMARY OF THE INVENTION

The present invention relates to a moisture inhibitor for engines that have a wet exhaust system. One object of the invention was to inhibit and prevent moisture and other contaminants from entering an engine through the engine's exhaust system where the exhaust system is a wet exhaust system. Another object of the invention was to stratify salt laden air in the exhaust system and precipitate, condense and trap moisture and contaminants in the exhaust system. Another object of the invention was to eliminate hydraulicing and the thermosyphon effect and condensation oscillation that occurs in the wet exhaust system of engines.

The present invention in one embodiment comprises a body having an entrance port, an exit port, a first descending portion that descends below the entrance port, a rising portion that rises above the entrance port, a second descending portion that descends below the entrance port to the exit port, a passage through the body from the entrance port to the exit port wherein the passage descends and passes through the first descending portion of the body and rises and passes through the rising portion of the body and descends and passes through the second descending portion of the body to the exit port and an upper trap coupled to the rising portion of the body above the entrance port in the passage of the body and a sloped wall having an upper portion and a lower portion that slopes down towards the exit port and is coupled to the second descending portion of the body so that the lower portion of the sloped wall is below the upper portion of the sloped wall and cooling means coupled to the body and a descending wall coupled to the second descending portion of the body so that the descending wall descends down below the sloped wall in the passage of the body.

In another embodiment the invention comprises a housing having a cavity, an entrance port passing through the housing to the cavity of the housing and an exit port passing through the housing to the cavity of the housing and a dividing wall inside the housing in the cavity of the housing coupled to the housing between the entrance port and the exit port wherein the dividing wall rises up in the cavity of the housing above the entrance port and above the exit port and a lower trap coupled to the housing below the entrance port and a sloped floor coupled to the housing below the entrance port which slopes down and away from the entrance port towards the lower trap and is coupled to the lower trap and an upper trap coupled to the housing in the cavity of the housing above the entrance port and a sloped wall coupled to the dividing wall so that the sloped wall slopes down and away from the entrance port towards the exit port and cooling means coupled to the housing and a descending wall coupled to the interior surface of the housing so that the descending wall descends down from the interior surface of the housing down into the second portion of the cavity of the housing and down below the sloped wall.

In another embodiment the invention comprises a housing having a cavity, a first front side, an entrance port through the first front side, a second front side that slants forward, a first top side, a second top side that slants forward, a rear side, a first bottom side, an exit port through the first bottom side, a second bottom side, a lower trap wall, a third bottom side that slants, a left side, a right side and further comprises a dividing wall that rises above the entrance port and the exit port and an upper trap above the entrance port and a sloped wall and cooling means. In one embodiment the cooling means is a water jacket.

DETAILED DESCRIPTION

Reference is now made to the accompanying drawings for a better understanding of the invention wherein all the parts are numbered and directions and distances are indicated by letters.

Figure 1:
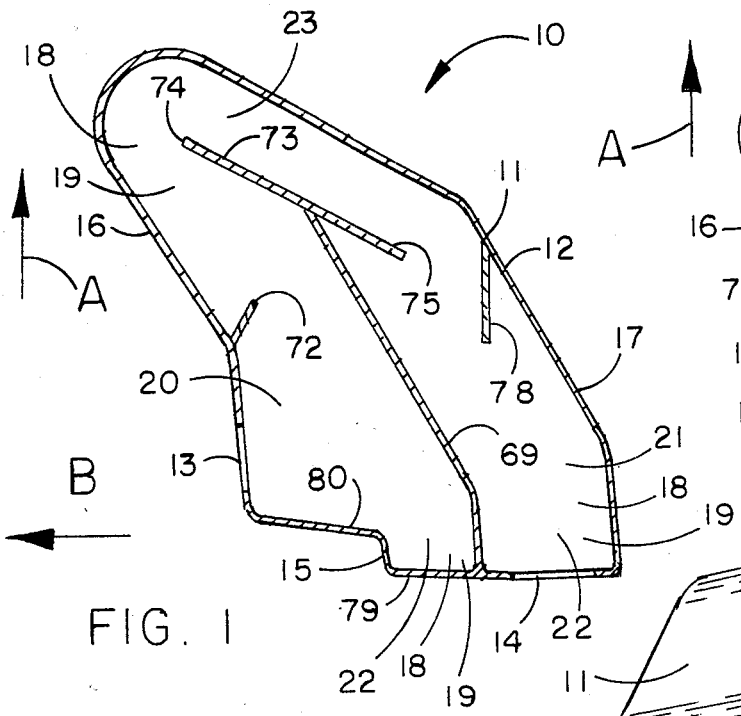
FIG. 1 is a cross-section plan view of the moisture inhibitor and an embodiment comprising a first descending portion, a rising portion and a second descending portion.
Figure 8:
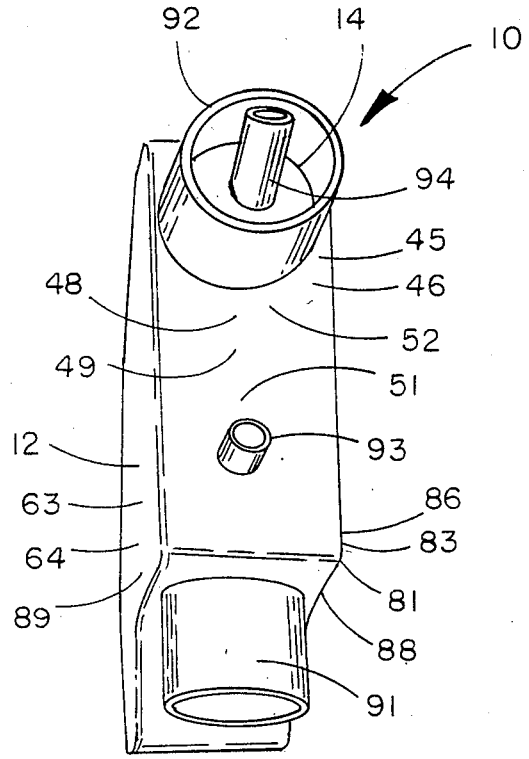
FIG. 8 is a bottom perspective view of the embodiment shown in FIG. 7.

In the embodiment shown in FIG. 1 a moisture inhibitor 10 is indicated generally comprising a body 11 having an entrance port 13, an exit port 14, a first descending portion 15 that descends below the entrance port 13, a rising portion 16 that rises above the entrance port 13, a second descending portion 17 that descends below the entrance port 13 to the exit port 14, a passage 18 through the body 11 from the entrance port 13 to the exit port 14 wherein the passage 18 descends and passes through the first descending portion 15 of the body 11 and rises and passes through the rising portion 16 of the body 11 and descends and passes through the second descending portion 17 of the body 11 to the exit port 14 and an upper trap 72 coupled to the rising portion 16 of the body 11 above the entrance port 13 in the passage 18 of the body 11. With the exception of FIG. 8 the drawings show the moisture inhibitor 10 in the position that it will be in when in its anticipated use and the arrow A indicates up and the upward direction which is toward the top of the page. Down or downward would be in a direction that is opposite the arrow A and would be towards the bottom of the drawing. The arrow B indicates the forward direction which would be towards the left in the drawing as shown in FIG. 1 and the rearward direction would be the opposite direction of arrow B which would be towards the right of the drawing in FIG. 1.

Figure 2:
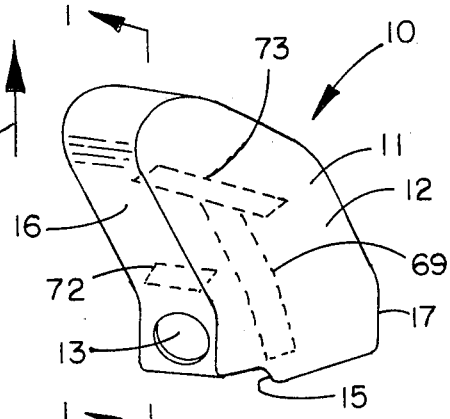
FIG. 2 is a front perspective view of the embodiment shown in FIG. 1.

One of the more important uses of the moisture inhibitor 10 is in the exhaust systems of marine and boat engines that use a wet exhaust system. Many marine engines are conventional automobile engines that have been modified for marine use. The typical marine engine will have cylinders that have pistons reciprocating inside of them driving a crankshaft and will have an intake valve for fuel and an exhaust valve to allow the product of combustion to leave the cylinder of the marine engine and enter the exhaust manifold and then enter the exhaust pipe. The typical marine engine is water cooled and the water after passing through various passages in the engine will then be introduced into the exhaust pipe which is where the term wet exhaust comes from. The typical exhaust pipe of a marine engine is then connected to an aqualift which is a container partially filled with water in which the exhaust is introduced into the aqualift below the level of the water and when the engine is running it will build up pressure forcing the product of combustion and water to enter another pipe below the surface of the water in the aqualift and rise in the pipe above the level of the water in the aqualift and then continue outside the boat where the products of combustion and water are expelled into the body of water that the boat is in. Unfortunately when the marine engine is shut off the temperature of the engine increases substantially because the coolant is no longer circulating through the engine and a substantial amount of heat is transferred to the exhaust manifold and to the exhaust system. Eventually the gases in the exhaust system and the exhaust pipe will cool and contract which causes water and contaminants in the water to be sucked and syphoned from the aqualift into the exhaust pipe between the aqualift and the exhaust manifold. Since the exhaust system of a marine engine is quite hot the water in the exhaust pipe will vaporize and turn to steam and carry contaminants in the water with it. The water in the form of steam and the contaminants in the water will travel back in the exhaust pipe into the exhaust manifold and enter the exhaust ports, valve guides and cylinder walls of the engine causing adverse effects to the valves, valve guides, lifters, cylinder walls, pistons, piston rings and wrist pins. It is estimated that one-third of the marine engines on boats have the foregoing problem especially sailboat engines. This phenomenon is sometimes referred to as inhalation of exhaust system generated water or hydraulicing or the thermosyphon effect or condensation oscillation. The moisture inhibitor 10 is designed to cure this problem and prevent moisture and other contaminants from going back through the exhaust system into the engine. The moisture inhibitor 10 can be installed on the engine to the exhaust manifold in between the exhaust manifold and the boat's aqualift and before the point at which coolant is introduced into the exhaust system. With reference to FIG. 1 the exhaust pipe of the marine engine can be introduced into the entrance port 13 where the exhaust would go through the first descending portion 15 of the body 11 then go through the rising portion 16 of the body 11 then go through the second descending portion 17 of the body 11 by traveling through the passage 18 then leave the moisture inhibitor 10 by going through the exit port 14 at which point another exhaust pipe should be introduced into the exit port 14 to carry the exhaust away. While the engine is running the exhaust should travel through the passage 18 of the body 11 on its way to the exhaust system. When the engine is shut off steam will enter the exit port 14 and rise up in the second descending portion 17 and condense and puddle in the second descending portion 17 and drain back down in the second descending portion 17 and eventually leave the moisture inhibitor 10 by going through the exit port 14 by virtue of the pull of gravity. In the event that any steam rises up in the second descending portion 17 of the body 11 and enters the first descending portion 15 of the body 11 the rising portion 16 of the body 11 will enhance precipitation and condensation which will be caught above the entrance port 13 by the trap 72 which goes across the passage 18 in the rising portion 16 of the body 11 above the entrance port 13. The moisture that is caught by the upper trap 72 will remain there until it evaporates or the engine is restarted and the hot exhaust eventually will cause the water caught to evaporate and be carried away by the exhaust. In the event that the water overflows the upper trap 72 it will fall down into the first descending portion 15 of the body 11 and be caught in the first descending portion 15 of the body 11 since the first descending portion 15 of the body 11 is below the entrance port 13. Moisture tends to continue faster on the surface than in the air. Therefore, another embodiment of the invention further comprises a sloped wall 73 having an upper portion 74 and a lower portion 75 that slopes down towards the exit port 14 and is coupled to the second descending portion 17 of the body 11 so that the lower portion 75 of the sloped wall 73 is below the upper portion 74 of the sloped wall 73. The sloped wall 73 is shown in FIG. 1 and is shown in FIG. 2 by the use of dashed lines and is shown in FIGS. 6, 7, 9, 10 and 11 in various embodiments of the moisture inhibitor 10. The sloped wall 73 encourages and enhances precipitation and condensation by its presence by giving the steam and other gases something to condense on. After precipitation and condensation the moisture and other contaminants will run down the sloped wall 73 and eventually reach the exit port 14 and gravity will cause it to leave the moisture inhibitor 10 thereby preventing the moisture from reaching the engine. A front perspective view of the embodiment shown in FIG. 1 is shown in FIG. 2 where the upper trap 72 is shown inside the moisture inhibitor 10 by dashed line as is the sloped wall 73. A rear and bottom perspective view of the embodiment shown in FIG. 1 and FIG. 2 is shown in FIG. 3.

Figure 4:
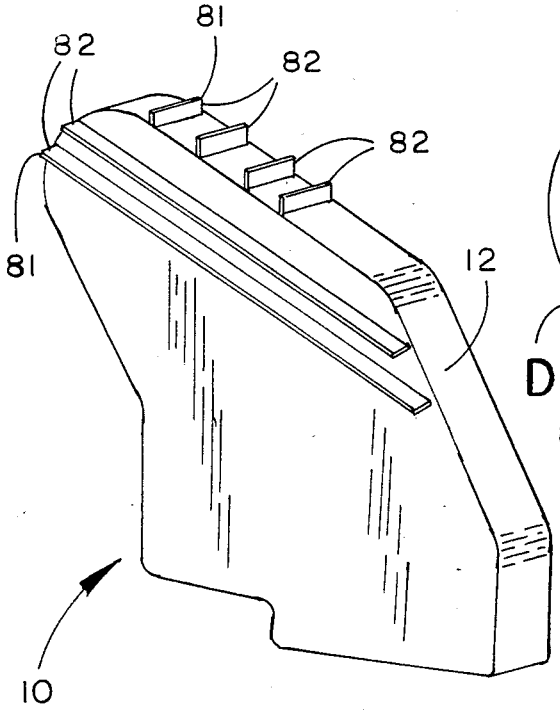
FIG. 4 is a side perspective view of an embodiment of the moisture inhibitor wherein the cooling means are a parallity of fins.
Figure 5:
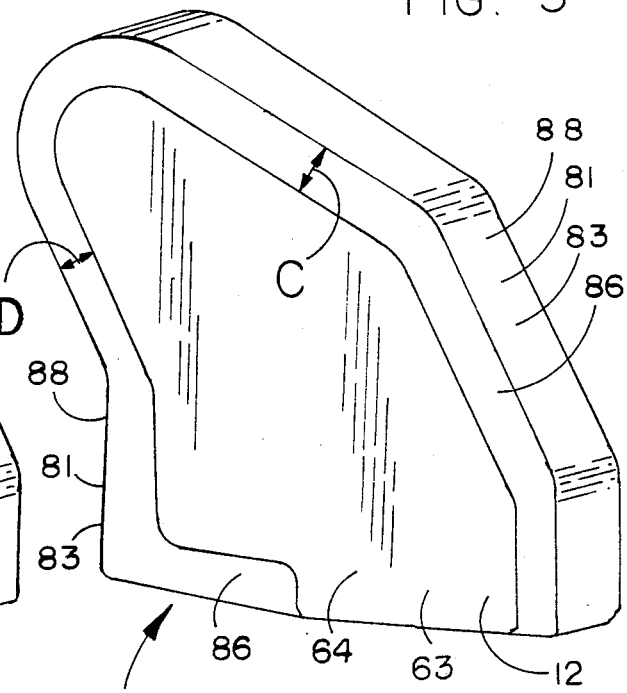
FIG. 5 is a side perspective view of an embodiment of the moisture inhibitor wherein the cooling means is a jacket.

Exhaust gases leaving the exhaust manifold and entering the moisture inhibitor 10 may reach temperatures exceeding 500 degrees Farenheit. It is thought desirable to cool the moisture inhibitor 10 for safety reasons and also for the purpose of encouraging and enhancing precipitation and condensation in the moisture inhibitor 10. The embodiment of the moisture inhibitor 10 shown in FIGS. 1, 2 and 3 is shown in FIG. 4 further comprising cooling means 81 coupled to the body 11 wherein the cooling means 81 is a plurality of fins 82. The fins 82 will provide more contact with the outside air and result in more cooling of the moisture inhibitor 10. In FIG. 5 cooling means 81 are shown wherein the cooling means is a jacket 83, preferably a water jacket 86, coupled to the body 11 of the embodiment of the moisture inhibitor 10 that is shown in FIGS. 1, 2 and 3.

Precipitation and condensation are further enhanced and encouraged in the embodiment of the moisture inhibitor 10 shown in FIGS. 1, 2 and 3 by coupling a descending wall 78 to the second descending portion 17 of the body 11 so that the descending wall 78 descends down below the sloped wall 73 in the passage 18 of the body 11. The descending wall 78 will also catch and stop vapors from rising because the descending wall 78 goes completely across the passage 18. After the vapors are caught the vapors will precipitate and condense on the descending wall 78 and drip off the descending wall 78 by reason of gravity and fall eventually through the exit port 14. It is a preferred embodiment that the body 11 of moisture inhibitor 10 be a housing 12. A housing 12 is a preferred embodiment because it can provide more space inside and is easier and cheaper to build.

Figure 3:
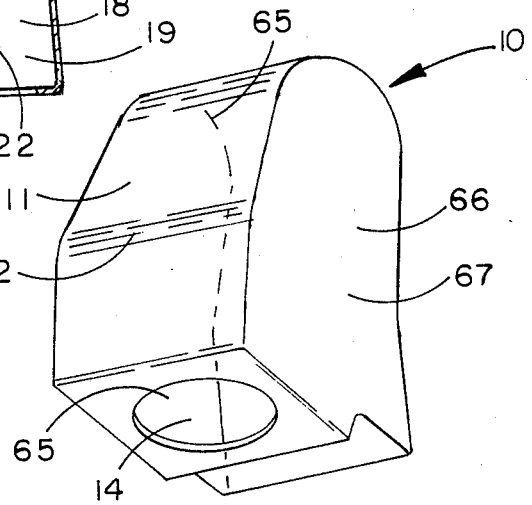
FIG. 3 is a rear end bottom perspective view of the embodiment shown in FIGS. 1 and 2 with the dividing wall removed.

In the embodiment shown in FIGS. 1, 2 and 3 a moisture inhibitor 10 is shown comprising a housing 12 having a cavity 19, and an entrance port 13 passing through the housing 12 to the cavity 19 of the housing 12 to the cavity 19 of the housing 12 and an exit port 14 passing through the housing 12 to the cavity 19 of the housing 12. The moisture inhibitor 10 further comprises a dividing wall 69 inside the housing 12 in the cavity 19 of the housing 12 coupled to the housing 12 between the entrance port 13 and the exit port 14 wherein the dividing wall 69 rises up in the cavity 19 of the housing 12 above the entrance port 13 and above the exit port 14 and a lower trap 79 coupled to the housing 12 below the entrance port 13. As shown in FIG. 1 the dividing wall 69 only partially divides the cavity 19 of the housing 12 which results in a passage 18 through the housing 12. The dividing wall 69 is between the entrance port 13 and the exit port 14 in order to prevent any liquids in the exhaust system from entering the exit port 14 and traveling to the entrance port 13. Any such liquid would have to rise up and over the dividing wall 69 but this is unlikely because of the effect of gravity which would pull the liquid down towards the exit port 14. The moisture inhibitor 10 would be installed so that it is above the exhaust pipe of the boat and is above the aqualift of the boat which would help to minimize the possibility of liquids in the exhaust system of the boat from entering the exit port 14. The dividing wall 69 is completely across the housing 12 so that the only way that liquids could reach the entrance port 13 from the exit port 14 would be to rise up and over the dividing wall 69. In a preferred embodiment the dividing wall 69 is coupled to the housing 12 by connecting the dividing wall 69 to the housing 12. The dividing wall 69 is not a complete barrier to vapors, steam or gases that may contain contaminants such as salt. Such vapors could rise up and over the dividing wall 69 and condense inside the moisture inhibitor 10. Such condensation would then be caught in the lower trap 79 since the lower trap 79 is below the entrance port 13 and the lower trap 79 is completely across the moisture inhibitor 10 and acts as a storage box for any liquids that fall into it. The liquids would remain in the lower trap 79 until the engine is restarted when the high temperatures from the engine exhaust would eventually vaporize the liquids and carry the vaporized liquids through the moisture inhibitor 10 and out through the exit port 14. A drain, not shown, could be installed in the lower trap 79 with a drain valve, not shown, to remove any liquids that enter the lower trap 79. It is preferred that a sloped floor 80 be coupled to the housing 12 below the entrance port 13 which slopes down and away from the entrance port 13 towards the lower trap 79 and that the sloped floor 80 be coupled to the lower trap 79. The sloped floor 80 may be coupled to the housing 12 by connecting the sloped floor 80 to the housing 12 completely across the housing 12 and connecting the sloped floor 80 to the lower trap 79 so that when liquid reaches the sloped floor 80 the liquid will run towards the lower trap 79 and fall into the lower trap 79. It is preferred that the sloped floor 80 be connected to the housing 12 between the entrance port 13 and the lower trap 79 so that any liquid caught in the lower trap 79 will be kept a distance away from the entrance port 13 to prevent any such liquid from entering the entrance port 13.

The performance of the moisture inhibitor 10 is enhanced by coupling an upper trap 72 to the housing 12 in the cavity 19 of the housing 12 above the entrance port 13. It is preferred that the upper trap 72 be coupled to the housing 12 by connecting the upper trap 72 completely across the housing 12 so that exhaust gases may enter the entrance port 13 and go up and over the upper trap 72 but if liquids fall in the housing 12 above the upper trap 72 then the upper trap 72 will catch such liquids and hold them there until the engine is restarted and hot exhaust gases vaporize the liquids held. The lower trap 79, sloped floor 80 and upper trap 72 are also show in FIGS. 7, 9, 10 and 11.

Figure 6:
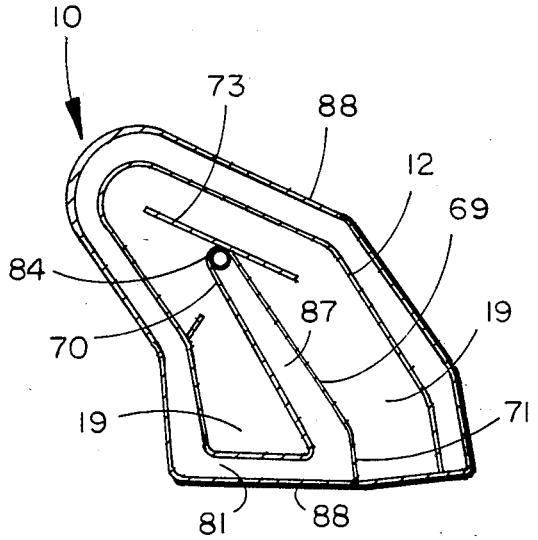
FIG. 6 is a side cross-section plan view of an embodiment of the moisture inhibitor wherein the dividing wall has a cavity and is coupled to the cooling means and further has an inlet at the upper portion of the dividing wall.

In the embodiments shown in FIGS. 1, 2, 6, 7, 9, 10 and 11 the moisture inhibitor 10 further comprises a sloped wall 73 coupled to the dividing wall 69 so that the sloped wall 73 slopes down and away from the entrance port 13 towards the exit port 14. The embodiment shown in FIGS. 4, 5, 6, 7, 8, 9, 10 and 11 show a moisture inhibitor 10 further comprising cooling means 81 coupled to the housing 12 wherein the cooling means 81 is a plurality of fins 82 coupled to the housing 12 and in FIGS. 5 through 14 the cooling means 81 is a jacket 83 coupled to the housing 12. In a preferred embodiment the jacket 83 has an inlet 84 below the entrance port 13 and an outlet 85 that goes through the exit port 14. In one embodiment the cooling means 81 is a water jacket 86 coupled to the housing 12. Additional cooling capacity can be obtained in an embodiment wherein the dividing wall 69 has an upper portion 70 and a cavity 87 and is coupled to the cooling means 81 and the cooling means 81 has an inlet 84 at the upper portion 70 of the dividing wall 69. For marine engine use it is a preferred embodiment that the cooling means 81 to be a water jacket 86 because water is plentiful wherever marine engines are used and water can be introduced into the water jacket 86 by pumping water from the body of water that the boat is in to the inlet 84 where the water will then flow through the water jacket 86 and out through the outlet 85. The water in the water jacket 86 will cool the housing 12 as the water flows through the water jacket 86. It is preferred that the inlet 84 be below the entrance port 13 as shown in FIGS. 7 through 11 because the exhaust gases entering the entrance port 13 may be as hot as 500 degrees Farenheit and maximum cooling will occur closest to the inlet 84 when the engine is running. Additional cooling can also be obtained as shown in FIG. 6 where the dividing wall 69 has a cavity 87 and the inlet 84 goes through to the cavity 87 of the dividing wall 69 at the upper portion 70 of the dividing wall 69. As shown in FIG. 6 water could be introduced at the inlet 84 which would then flow down the cavity 87 of the dividing wall 69 then below the housing 12 and below the entrance port 13 to provide additional cooling.

In the embodiments shown in FIGS. 5, 7, 9, 10 and 11 the cooling capacity of the cooling means 81 is greater rearward of the dividing wall 69 than the cooling capacity of the cooling means 81 is forward of the dividing wall 69. The purpose of this is to enhance precipitation and condensation on the sloped wall 73 to prevent gases carrying moisture and salt from passing up and over the sloped wall 73 in order to avoid moisture from entering the entrance port 13 from the cavity 19 of the housing 12. This may be accomplished where the cooling means 81 is a jacket 83 that has a jacket wall 88 that is at a variable distance C and D from the housing 12 and the jacket wall 88 is closer to the housing 12 forward of the dividing wall 69 than the jacket wall 88 is rearward of the dividing wall 69. The forward direction is indicated by the arrow B and is that direction from the dividing wall 69 towards the entrance port 13 where the rearward direction is the opposite direction. Since the jacket wall 88 is closer to the housing 12 forward of the dividing wall 69 than the jacket wall 88 is rearward of the dividing wall 69 greater cooling will occur in the cavity 19 of the housing 12 near the sloped wall 73 which will cause heavier moisture and/or salt laden air to stratify and separate during the shutdown mode of the marine engine and to precipitate and condense and flow back down towards the exit port 14. This will allow only the lighter hot gases free of moisture to flow over the sloped wall 73 and reach the entrance port 13.

In the embodiment shown in FIGS. 1, 2, 6, 7, 9, 10 and 11 the cavity 19 of the housing 12 has an upper portion 23 and a lower portion 22 and is divided into a first portion 20 and a second portion 21 by the dividing wall 69 and the entrance port 13 goes through to the first portion 20 of the cavity 19 of the housing 12 in the lower portion 22 of the cavity 19 of the housing 12 and the exit port 14 goes through to the second portion 21 of the cavity 19 of the housing 12 in the lower portion 22 of the cavity 19 of the housing 12. As shown in FIGS. 1, 7, 9, 10 and 11 the housing 12 has an interior surface 90 further comprising a descending wall 78 coupled to the interior surface 90 of the housing 12 so that the descending wall 78 descends down from the interior surface 90 of the housing 12 down into the second portion 21 of the cavity 19 of the housing 12 and down below the sloped wall 73. The position of the descending wall 78 is such that it will hinder vapors, steam and gases from rising up in the second portion 21 of the cavity 19 of the housing 12. The up direction is indicated by the arrow A and is the direction pointing towards the top of the drawing.

The embodiments shown in FIGS. 7 through 11 represent a preferred embodiment of the moisture inhibitor 10. The moisture inhibitor 10 comprises a housing 12 having a cavity 19 having a first portion 20 and a second portion 21 and a lower portion 22 and an upper portion 23, a first front side 24 having an upper portion 25 and a lower portion 26 and an exterior surface 27 and an interior surface 28, and an entrance port 13 from the exterior surface 27 of the first front side 24 of the housing 12 through the first front side 24 of the housing 12 to the interior surface 28 of the first front side 24 of the housing 12 to the cavity 19 of the housing 12, a second front side 29 having an exterior surface 30 and an interior surface 31 and an upper portion 32 and a lower portion 33 connected to the upper portion 25 of the first front side 24 of the housing 12 so that the second front side 29 of the housing 12 slants forward and the interior surface 31 of the upper portion 32 of the second front side 29 of the housing 12 is forward of the interior surface 31 of the lower portion 33 of the second front side 29 of the housing 12 and forward of the interior surface 28 of the first front side 24 of the housing 12, a first top side 34 having an exterior surface 35 and an interior surface 36 connected to the upper portion 32 of the second front side 29 of the housing 12, a second top side 37 having an upper portion 38 and a lower portion 39 and an exterior surface 40 and an interior surface 41 connected to the first top side 34 of the housing 12 so that the second top side 37 of the housing 12 slants forward and the interior surface 41 of the upper portion 38 of the second top side 37 of the housing 12 is forward of the interior surface 41 of the lower portion 39 of the second top side 37 of the housing 12, a rear side 42 having an exterior surface 43 and an interior surface 44 connected to the lower portion 39 of the second top side 37 of the housing 12, a first bottom side 45 having an exterior surface 46 and an interior surface 47 connected to the rear side 42 of the housing 12, and an exit port 14 from the exterior surface 46 of the first bottom side 45 of the housing 12 through the first bottom side 45 of the housing 12 to the interior surface 47 of the first bottom side 45 of the housing 12 to the cavity 19 of the housing 12, a second bottom side 48 having an exterior surface 49 and an interior surface 50 and a front portion 51 and a rear portion 52 with the rear portion 52 of the second bottom side 48 of the housing 12 connected to the first bottom side 45, a lower trap wall 53 having an exterior surface 54 and an interior surface 55 and an upper portion 56 and a lower portion 57 with the lower portion 57 of the lower trap wall 53 of the housing 12 connected to the front portion 51 of the second bottom side 48 of the housing 12 so that the lower trap wall 53 of the housing 12 rises up above the second bottom side 48 of the housing 12, a third bottom side 58 having an exterior surface 59 and an interior surface 60 and a front portion 61 and a rear portion 62 with the rear portion 62 of the third bottom side 58 of the housing 12 connected to the upper portion 56 of the lower trap wall 53 of the housing 12 and with the front portion 61 of the third bottom side 58 of the housing 12 connected to the lower portion 26 of the first front side 24 of the housing 12 below the entrance port 13 so that the third bottom side 58 of the housing 12 slants so that the rear portion 62 of the third bottom side 58 of the housing 12 is lower than the front portion 61 of the third bottom side 58 of the housing 12, a left side 63 having an exterior surface 64 and an interior surface 65 connected to the first front side 24 of the housing 12 and second front side 29 of the housing 12 and first top side 34 of the housing 12 and second top side 37 of the housing 12 and rear side 42 of the housing 12 and first bottom side 45 of the housing 12 and second bottom side 48 of the housing 12 and the lower trap wall 53 of the housing 12 and third bottom side 58 of the housing 12, a right side 66 having an exterior surface 67 and an interior surface 68 connected to the first front side 24 of the housing 12 and second front side 29 of the housing 12 and first top side 34 of the housing 12 and second top side 37 of the housing 12 and rear side 42 of the housing 12 and first bottom side 45 of the housing 12 and second bottom side 48 of the housing 12 and lower trap wall 53 of the housing 12 and third bottom side 58 of the housing 12. This embodiment of the moisture inhibitor 10 further comprises a dividing wall 69 having an upper portion 70 and a lower portion 71 inside the housing 12 in the cavity 19 of the housing 12 connected to the interior surface 65 of the left side 63 of the housing 12 and the interior surface 68 of the right side 66 of the housing 12 and the interior surface 47 of the first bottom side 45 of the housing 12 and the second bottom side 48 of the housing 12 where the first bottom side 45 of the housing 12 and the second bottom side 48 of the housing 12 are connected together so that the dividing wall 69 divides the cavity 19 of the housing 12 into the first portion 20 of the cavity 19 of the housing 12 that is forward of the dividing wall 69 and the second portion 21 of the cavity 19 of the housing 12 that is rearward of the dividing wall 69 and the dividing wall 69 rises up in the cavity 19 of the housing 12 above the entrance port 13 and above the exit port 14. The dividing wall 69 acts like a barrier between the exit port 14 and the entrance port 13. The dividing wall 69 only partially divides the housing 12. The dividing wall 69 is completely across the housing 12 from the left side 63 of the housing 12 to the right side 66 of the housing 12. The dividing wall 69 is also completely across the first bottom side 45 of the housing 12 so that if any water enters the cavity 19 of the housing 12 through the exit port 14 then the water would have to completely rise up in the second portion 21 of the cavity 19 of the housing 12 and go over the dividing wall 69 before the water could approach the entrance port 13. The dividing wall 69 does not rise up all the way to the first top side 34 or to the second top side 37 so that exhaust gases may go up and over the dividing wall 69 and reach the exit port 14. With the dividing wall 69 in place as described above the cavity 19 is divided into a first portion 20 and a second portion 21 resulting in a passage 18 through the housing 12 as previously described and shown in FIG. 1. The cavity 19 is defined by the interior surface 90 of the housing 12. The interior surface 90 of the housing 12 comprises the interior surface 28 of the first front side 24 and the interior surface 31 of the second front side 29 and the interior surface 36 of the first top side 34 and the interior surface 41 of the second top side 37 and the interior surface 44 of the rear side 42 and the internal surface 47 of the first bottom side 45 and the interior surface 50 of the second bottom side 48 and the interior surface 55 of the lower trap wall 53 and the interior surface 60 of the third bottom side 58 and the interior surface 65 of the left side 63 and the interior surface 68 of the right side 66 of the housing 12. The reference to rearward of the dividing wall 69 means the direction to the right of the dividing wall 69 and is the direction from left to right on the sheet of the drawing for FIG. 7. Up means from the bottom of the sheet of the drawing towards the top of the sheet of the drawing as shown by the arrow A. The rearward direction is the opposite of the arrow B.

The embodiment shown in FIGS. 7 through 11 further comprises an upper trap 72 connected to the interior surface 65 of the left side 63 of the housing 12 and the interior surface 68 of the right side 66 of the housing 12 and the interior surface 31 of the lower portion 33 of the second front side 29 of the housing 12 above the entrance port 13 so that the upper trap 72 extends upward and rearward from the interior surface 31 of the second front side 29 of the housing 12. The upper trap 72 is completely across the housing 12 from the left side 63 of the housing 12 to the right side 66 of the housing 12. The upper trap 72 will catch any liquids that come down the interior surface 31 of the second front side 29 of the housing 12. This is facilitated by having the second front side 29 of the housing 12 slant forward so that any liquid falling down in the first portion 20 of the cavity 19 of the housing 12 above the upper trap 72 will strike the interior surface 31 of the second front side 29 of the housing 12 and run down towards the upper trap 72. The second front side 29 of the housing 12 is completely across the housing 12 from the left side 63 of the housing 12 to the right side 66 of the housing 12. In this embodiment the upper trap 72 is shaped like a rectangular wall and will catch and hold liquids and prevent the liquids from reaching the entrance port 13. Any such liquids will be caught and held by the upper trap 72 and the left side 63 of the housing 12 and the right side 66 of the housing 12 and the second front side 29 of the housing 12. The upper trap 72 should be positioned close to the entrance port 13 as shown in FIGS. 7, 9, 10 and 11 so as to prevent as much liquid as possible from reaching the entrance port 13 by going down the interior surface 31 of the second front side 29 and such positioning will also permit the upper trap 72 to act as a roof over the entrance port 13 thereby acting as an additional barricade to liquid falling down in the first portion 20 of the cavity 19 of the housing 12.

The second front side 29 slants forward to assist the upper trap 72 in catching liquids and also for the purpose of moving the center of gravity of the housing 12 further forward to lessen the effect of the eight of the moisture inhibitor 10 on the exhaust system of the marine engine that the moisture inhibitor 10 is attached to. The forward slant also enhances precipitation and condensation on the interior surface 31 of the second front side 29 of the housing 12 and permits other portions of the moisture inhibitor 10 to also be slanted as discussed hereinafter. Slanting forward means that the top portion is further forward than the bottom portion an example of which is in FIG. 7 where the upper portion 32 of the second front side 29 is further forward which in FIG. 7 means further to the left of the drawing than the lower portion 33 of the second front side 29 of the housing 12.

As shown in FIGS. 7, 9, 10 and 11 the upper portion 70 of the dividing wall 69 is further forward than the lower portion 71 of the dividing wall 69 because the upper portion 70 of the dividing wall 69 slants forward. This will enhance precipitation and condensation on the dividing wall 69 resulting in the liquids that are thus formed to fall back towards the exit port 14.

The embodiment shown in FIGS. 7 through 11 further comprises a sloped wall 73 having an upper portion 74 and a lower portion 75 and a top surface 76 and a bottom surface 77 wherein the sloped wall 73 is connected to the interior surface 65 of the left side 63 of the housing 12 and the interior surface 68 of the right side 66 of the housing 12 and the upper portion 70 of dividing wall 69 so that the upper portion 74 of the sloped wall 73 is in the upper portion 23 of the cavity 19 of the housing 12 and is above the dividing wall 69 and the lower portion 75 of the sloped wall 73 and is forward of the dividing wall 69 and the lower portion 75 of the sloped wall 73. In this embodiment the sloped wall 73 has a rectangular shape and is across the housing 12 from the left side 63 of the housing 12 to the right side 66 of the housing 12. Liquid on the top surface 76 of the sloped wall 73 will run down the sloped wall 73 towards the exit port 14. It is preferred that the sloped wall 73 be in the upper portion 23 of the cavity 19 of the housing 12 so that when the engine is shut off gases, steam and vapors will precipitate and condense on the top surface 76 of the sloped wall 73 thereby preventing gases, steam and vapors from entering the first portion 20 of the cavity 19 of the housing 12 which also prevents the gases, steam and vapors from reaching the entrance port 13 which prevents them from reaching the engine.

The embodiment shown in FIGS. 7 through 11 further comprises cooling means 81 wherein the cooling means 81 is a jacket 83 that has a jacket wall 88 coupled to the housing 12 forward of the first front side 24 of the housing 12, forward of the second front side 29 of the housing 12, above the first top side 34 of the housing 12, above the second top side 37 of the housing 12, rearward of the rear side 42 of the housing 12 and below the third bottom side 58 of the housing 12 with an inlet 84 through the jacket wall 88 below the third bottom side 58 and an outlet 85 through the rear side 42 of the housing 12 and descending down through the exit port 14. In this embodiment the jacket wall 88 is connected to the left side 63 of the housing 12 and the right side 66 of the housing 12 and to the rear side 42 of the housing 12 and to the first bottom side 45 of the housing 12 and to the lower trap wall 53 of the housing 12. The coolant is not shown in the drawings but since the moisture inhibitor 10 will be used primarily in boats it is quite natural that water be the coolant. It is preferred that the outlet 85 go through the exit port 14 to help prevent any of the coolant from coming back into the cavity 19.

The embodiment shown in FIGS. 7 through 11 further comprises an entrance nipple 91 connected to the exterior surface 27 of the first front side 24 of the housing 12 at the entrance port 13 and an exit nipple 92 connected to the exterior surface 46 of the first bottom side 45 of the housing 12 at the exit port 14, an inlet nipple 93 connected to the jacket wall 88 at the inlet 84 and an outlet nipple 94 connected to the rear side 42 of the housing 12 so that the outlet nipple 94 descends down through the exit port 14 down into the exit nipple 92. The entrance nipple 91 will facilitate connecting the moisture inhibitor 10 to the exhaust system of the engine in that the exhaust pipe from the exhaust manifold of the engine may be connected directly to the entrance nipple 91. Likewise an exit nipple 92 will facilitate connecting the moisture inhibitor 10 to the exhaust system of the engine. The inlet nipple 93 and the outlet nipple 94 will facilitate connecting the moisture inhibitor 10 to a source of coolant. Hoses, not shown, can be connected directly to the inlet nipple 93 and outlet nipple 94 for the purpose of introducing coolant into the jacket 83 and removing the coolant from the jacket 83.

In the embodiment shown in FIGS. 7 through 11 the first front side 24, second front side 29, rear side 42, first bottom side 45, second bottom side 48, third bottom side 58, left side 63 and right side 66 of the housing 12 are flat which makes the moisture inhibitor 10 easier to build and more compact as will be discussed hereafter. The interior surface 36 of the first top side 34 is concave to improve and facilitate the flow of exhaust gases through the moisture inhibitor 10 when the engine is running.

In the embodiment shown in FIGS. 7 through 11 the first front side 24 of the housing 12 and the rear side 42 of the housing 12 are vertical and the first bottom side 45 of the housing 12 is horizontal. The vertical direction is the upright direction as shown by the arrow A. The horizontal direction is perpendicular to the vertical direction. With respect to the sheet that the drawings are on the vertical direction would go from the bottom of the sheet to the top of the sheet and the horizontal direction would go from the left side of the sheet to the right side of the sheet for FIGS. 1 and 7. Having the first front side 24 of the housing 12 vertical will enhance the connection of the moisture inhibitor 10 to the exhaust system of the engine as discussed hereafter.

Figure 7:
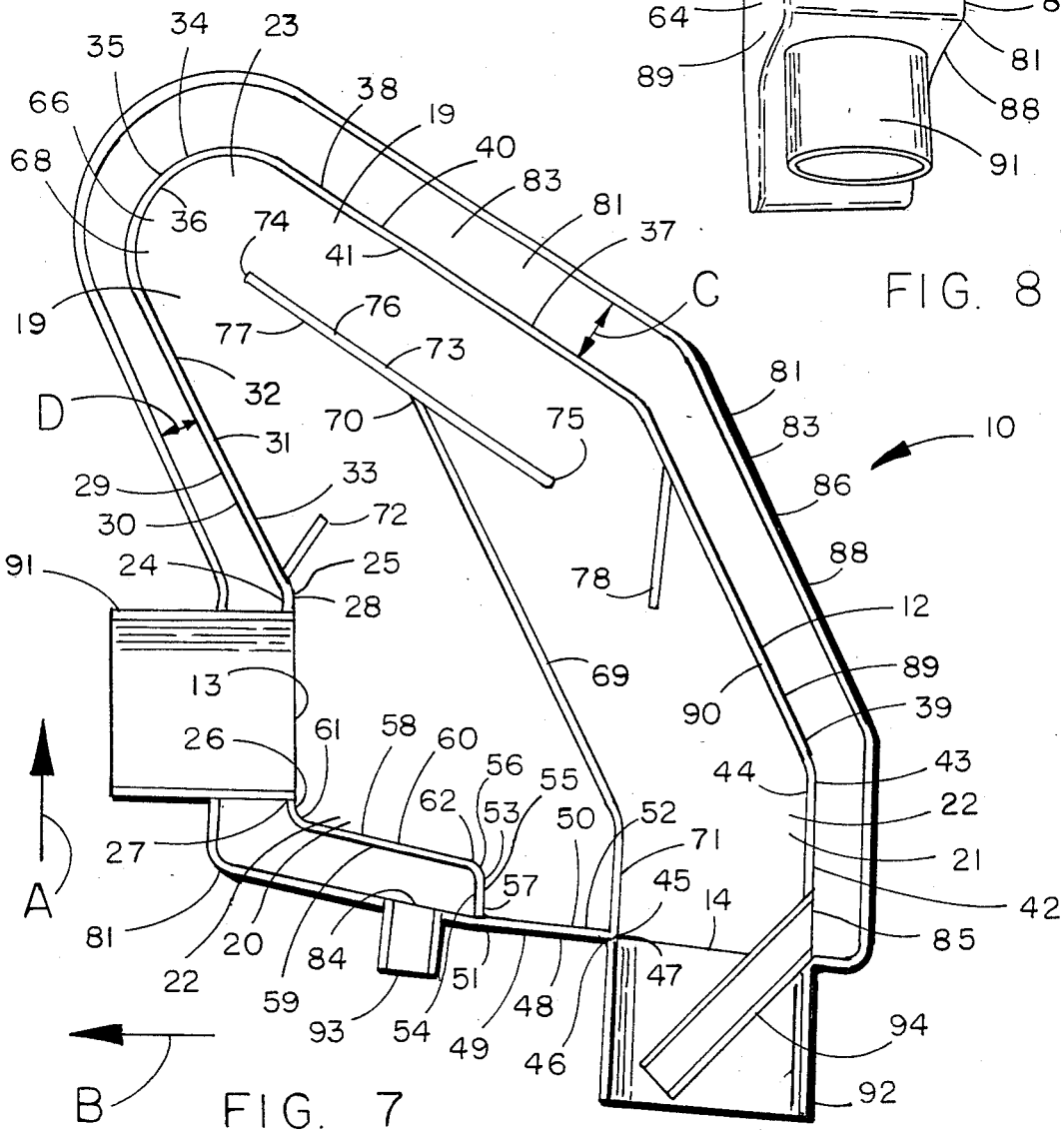
FIG. 7 is a side cross-section plan view of an another embodiment of the moisture inhibitor.

In the embodiment shown in FIGS. 7 through 11 the entrance port 13 is cylindrical and horizontal and the exit port 14 is cylindrical and vertical. It is preferred that the entrance port 13 and the exit port 14 be cylindrical because the exhaust pipes used in boat exhaust systems are cylindrical and this would facilitate installation in the boat. It is preferred that the entrance port 13 also be horizontal so that in the event any liquid enters the entrance port 13 from the cavity 19 then the liquid will not flow through the entrance port 13 since gravity would tend to hold any such fluid in one position. If the entrance port 13 was vertical or not horizontal then any liquid entering the entrance port 13 would tend to flow inside the entrance port 13. A horizontal orientation for the entrance port 13 will also help assure that the moisture inhibitor 10 is installed in the exhaust system in the proper position. One need only orientate the moisture inhibitor so that the entrance port 13 is orientated the same way as the horizon. In FIG. 7 the entrance port 13 is horizontal, that is, the same direction as the bottom edge of the sheet of the drawing and the same direction as the arrow B. It is preferred that the exit port 14 be vertical so that any liquid inside the second portion 21 of the cavity 19 of the housing 12 will fall out of the moisture inhibitor 10 through the exit port 14. The vertical direction is the same direction as the arrow A and is the same direction as the long sides of the sheet of the drawing that FIG. 7 is on. It is preferred that the first front side 24 and the first bottom side 45 be flat to facilitate installation of the moisture inhibitor 10 in the proper position in the exhaust system and to facilitate installation of the entrance nipple 91 in the proper position and to facilitate installation of the exit nipple 92 in the proper position. In the embodiments wherein there is no entrance nipple 91 and no exit nipple 92 the flat surfaces of the first front side 24 and the first bottom side 45 will assist in properly orientating the moisture inhibitor 10 in the proper position and orientation in the exhaust system of the boat. For example the moisture inhibitor 10 should be installed so that the sloped floor 80 will cause any liquid on it to flow away from the entrance port 13. The flat surfaces of the first front side 24 and first bottom side 45 will provide guidance in installing the moisture inhibitor 10 so that the sloped floor 80 is properly orientated. The moisture inhibitor 10 will be used in boats that are in turn used in salt water. The coolant passing through the water jacket 86 may be salt water. This requires that the moisture inhibitor 10 be made from materials that do not easily corrode. Furthermore since hot exhaust gases will be traveling through the moisture inhibitor 10 the material that it is made from must be exceptionally strong. Therefore, it is preferred that the moisture inhibitor 10 be made from stainless steel. It is also possible to make the moisture inhibitor 10 from manganese bronze. It is preferred that the housing 12, dividing wall 69, upper trap 72, sloped wall 73 and jacket wall 88 be made from sheets of flat stainless steel. One sheet of flat stainless steel may be bent several times to form the lower trap wall 53, third bottom side 58, first front side 24, second front side 29, first top side 34, second top side 37, and rear side 42 of the housing 12. A press could be used to form the desired bends. It is also possible to cut a sheet of flat stainless steel into several parts and then to weld them together to form the various sides of the housing 12.

Figure 9:
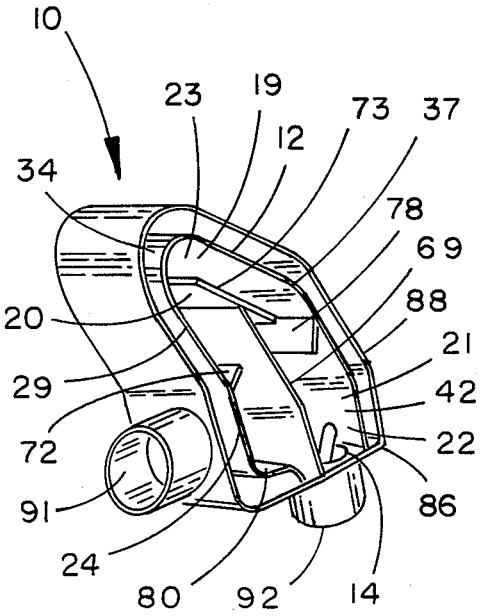
FIG. 9 is a front perspective view of the embodiment shown in FIG. 7 with the left side removed.
Figure 11:
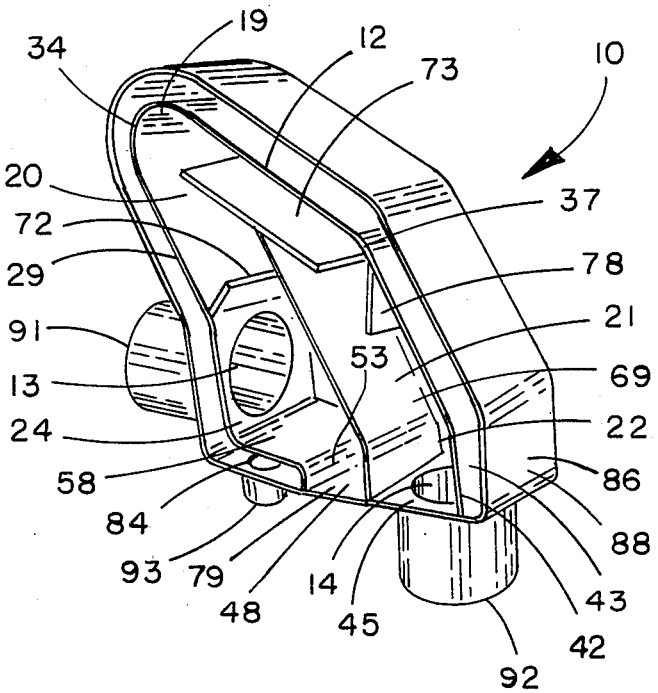
FIG. 11 is a rear perspective view of the embodiment shown in FIG. 7 with the left side removed.
Figure 10:
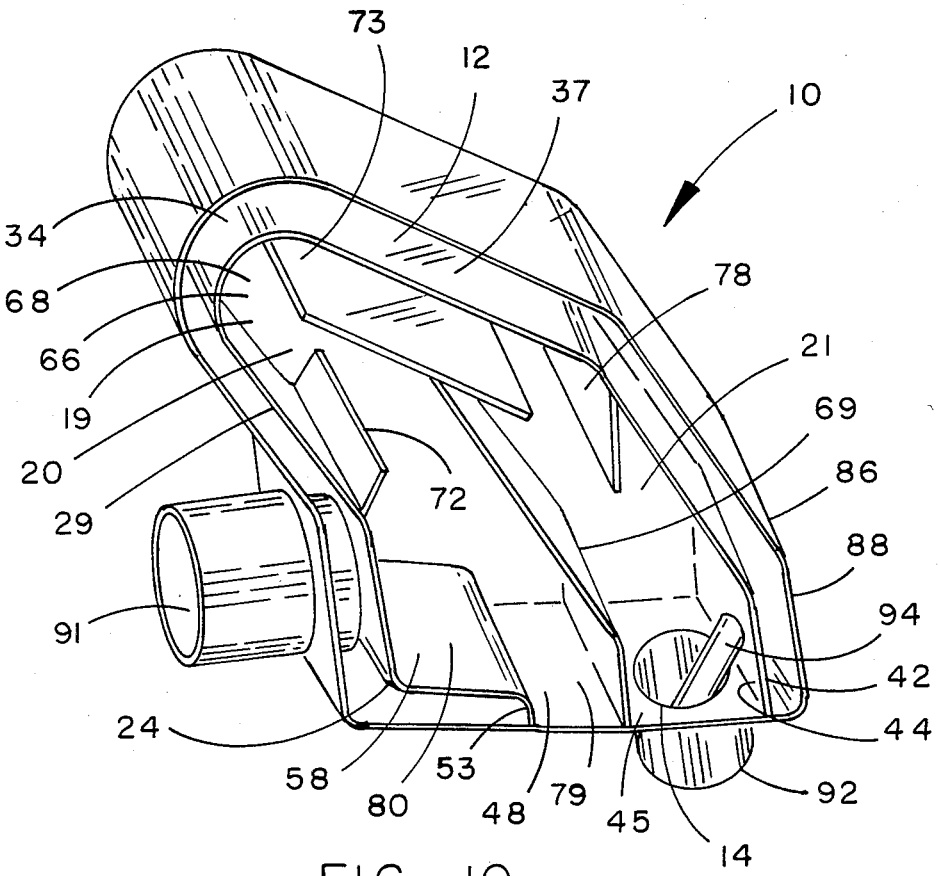
FIG. 10 is a side perspective view of the embodiment shown in FIG. 7 with the left side removed.

The embodiment shown in FIGS. 7, 9, 10 and 11 further comprises a descending wall 78 connected to the interior surface 41 of the second top side 37 of the housing 12 so that the descending wall 78 descends down from the interior surface 41 of the lower portion 39 of the second top side 37 down below the sloped wall 73. The purpose of this descending wall 78 is the same as in the previously discussed embodiments. It is preferred that the descending wall 78 have a rectangular shape and be completely across the moisture inhibitor 10 as shown in FIGS. 9, 10 and 11. The descending wall 78 may be welded directly to the second top side 37. Heliarc welding may be used for welding various parts together.

Where the moisture inhibitor 10 is made from stainless steel it is preferred that the thickness of the stainless steel be 0.090 inch.

The moisture inhibitor 10 may be used with gasoline engines or with diesel engines.

The moisture inhibitor 10 is designed to accomplish its purposes without introducing backpressure in the exhaust system. The moisture inhibitor 10 and its housing 12 and the cavity 19 of the housing 12 must be of sufficient size so as not to restrict the flow of exhaust gases when the engine is running.

The moisture inhibitor 10 may be made by cutting sheets of stainless steel and by stamping the sheets into the desired shape and where stamping is not practical, heliarc welding may be used.

Although the moisture inhibitor 10 is referred to as a moisture inhibitor 10 it is also a contaminant inhibitor in that it inhibits contaminants from entering the marine engine. The contaminants would typically be dissolved in the water that the engine uses as a coolant and one of the prime contaminants would be salt especially when the boat is used in salt water.

The moisture inhibitor 10 is both thermo-dynamic and thermo-reactive. It is dynamic in that the moisture inhibitor 10 is working constantly responding to the changes in atmosphere within and without the marine engine exhaust system. It is reactive in that the moisture inhibitor 10 responds immediately to the input of exhaust gases from the engine and the physical laws governing same when the engine is running and during the shut-down mode of the engine. However, the moisture inhibitor 10 is constantly performing whether the engine is running or not. The moisture inhibitor 10 performs the functions of a desalinator, a pyro-mechanical moisture eliminator, a moist air controller, a thermo-reactive salinity precipitator, a condensor, a separator, an isolator, a precipitator, convection device, a anti-thermo syphon device and a stratifier. The moisture inhibitor 10 thus solves problems that have been plaguing the boating industry for years.

It is to be understood that the invention is not limited to the exact details of construction, operation or exact materials or embodiments shown and described, as obvious modifications and equivalents will be apparent to one skilled in the art, and the invention is therefore to be limited only by the scope of the appended claims.

What is claimed is:

1. A moisture inhibitor, comprising:

a housing having a cavity having a first portion and a second portion and a lower portion and an upper portion, a first front side having an upper portion and a lower portion and an exterior surface and an interior surface, an entrance port from the exterior surface of the first front side of the housing through the first front side of the housing to the interior surface of the first front side of the housing to the cavity of the housing, a second front side having an exterior surface and an interior surface and an upper portion and a lower portion connected to the upper portion of the first front side of the housing so that the second front side of the housing slants forward and the interior surface of the upper portion of the second front side of the housing is forward of the interior surface of the lower portion of the second front side of the housing and forward of the interior surface of the first front side of the housing, a first top side having an exterior surface and an interior surface connected to the upper portion of the second front side of the housing, a second top side having an upper portion and a lower portion and an exterior surface and an interior surface connected to the first top side of the housing so that the second top side of the housing slants forward and the interior surface of the upper portion of the second top side of the housing is forward of the interior surface of the lower portion of the second top side of the housing, a rear side having an exterior surface and an interior surface connected to the lower portion of the second top side of the housing, a first bottom side having an exterior surface and an interior surface connected to the rear side of the housing, an exit port from the exterior surface of the first bottom side of the housing through the first bottom side of the housing to the interior surface of the first bottom side of the housing to the cavity of the housing, a second bottom side having an exterior surface and an interior surface and a front portion and a rear portion with the rear portion of the second bottom side of the housing connected to the first bottom side, a lower trap wall having an exterior surface and an interior surface and an upper portion and a lower portion with the lower portion of the lower trap wall of the housing connected to the front portion of the second bottom side of the housing so that the lower trap wall of the housing rises up above the second bottom side of the housing, a third bottom side having an exterior surface and an interior surface and a front portion and a rear portion with the rear portion of the third bottom side of the housing connected to the upper portion of the lower trap wall of the housing and with the front portion of the third bottom side of the housing connected to the lower portion of the first front side of the housing below the entrance port so that the third bottom side of the housing slants so that the rear portion of the third bottom side of the housing is lower than the front portion of the third bottom side of the housing, a left side having an exterior surface and an interior surface connected to the first front side of the housing and second front side of the housing and first top side of the housing and second top side of the housing and rear side of the housing and first bottom side of the housing and second bottom side of the housing and lower trap wall of the housing and third bottom side of the housing, a right side having an exterior surface and an interior surface connected to the first front side of the housing and second front side of the housing and first top side of the housing and second top side of the housing and rear side of the housing and first bottom side of the housing and second bottom side of the housing and lower trap wall of the housing;

a dividing wall having an upper portion and a lower portion inside the housing in the cavity of the housing connected to the interior surface of the left side of the housing and the interior surface of the right side of the housing and the interior surface of the first bottom side of the housing and the second bottom side of the housing where the first bottom side of the housing and the second bottom side of the housing are connected together so that the dividing wall divides the cavity of the housing into the first portion of the cavity of the housing that is forward of the dividing wall and the second portion of the cavity of the housing that is rearward of the dividing wall and the dividing wall rises up in the cavity of the housing above the entrance port and above the exit port;

an upper trap connected to the interior surface of the left side of the housing and the interior surface of the right side of the housing and the interior surface of the lower portion of the second front side of the housing above the entrance port so that the upper trap extends upward and rearward from the interior surface of the second front side of the housing;

a sloped wall having an upper portion and a lower portion and a top surface and a bottom surface wherein the sloped wall is connected to the interior surface of the left side of the housing and the interior surface of the right side of the housing and the upper portion of the dividing wall so that the upper portion of the sloped wall is in the upper portion of the cavity of the housing and is above the dividing wall and the lower portion of the sloped wall and is forward of the dividing wall and the lower portion of the sloped wall.

2. The invention as claimed in claim 1 further comprising cooling means.

3. The invention as claimed in claim 2 wherein the cooling means is a jacket that has a jacket wall coupled to the housing forward of the first front side of the housing, forward of the second front side of the housing, above the first top side of the housing, above the second top side of the housing, rearward of the rear side of the housing and below the third bottom side of the housing with an inlet through the jacket wall below the third bottom side of the housing and an outlet through the rear side of the housing and decending down through the exit port.

4. The invention as claimed in claim 3 further comprising:

an entrance nipple connected to the exterior surface of the first front side of the housing at the entrance port;

an exit nipple connected to the exterior surface of the first bottom side of the housing at the exit port;

an inlet nipple connected to the jacket wall at the inlet; and an outlet nipple connected to the rear side of the housing so that the outlet nipple descends down through the exit port down into the exit nipple.

5. The invention as claimed in claim 4 wherein the first front side of the housing is flat and the second front side of the housing is flat ant the interior surface of the first top side of the housing is concave and the rear side of the housing, first bottom side of the housing, second bottom side of the housing, third bottom side of the housing, left side of the housing and the right side of the housing are flat.

6. The invention as claimed in claim 5 wherein the first front side of the housing and the rear side of the housing are vertical and the first bottom side of the housing is horizontal.

7. The invention as claimed in claim 5 wherein the entrance port is cylindrical and horizontal and the exit port is cylindrical and vertical.

8. The invention as claimed in claim 5 wherein the moisture inhibitor is made from stainless steel.

9. The invention as claimed in claim 5 wherein the housing, dividing wall, upper trap, sloped wall and jacket wall are made from sheets of flat stainless steel.

10. The invention as claimed in claim 5 further comprising a descending wall connected to the interior surface of the lower portion of the second top side of the housing so that the descending wall descends down from the interior surface of the lower portion of the second top side of the housing down below the sloped wall.

11. A moisture inhibitor, comprising:

a housing having a cavity, an entrance port passing through the housing to the cavity of the housing, an exit port passing through the housing to the cavity of the housing;

an upper trap coupled to the housing in the cavity of the housing above the entrance port;

a dividing wall inside the housing in the cavity of the housing coupled to the housing between the entrance port and the exit port wherein the dividing wall rises up in the cavity of the housing above the entrance port and above the exit port wherein the dividing wall has an upper portion and a cavity;

a lower trap coupled to the housing below the entrance port;

a sloped wall coupled to the dividing wall so that the sloped wall slopes down and away from the entrance port towards the exit port; and cooling means coupled to the housing wherein the dividing wall is coupled to the cooling means wherein the cooling means has an inlet at the upper portion of the dividing wall.

* * * * *